United States Patent [19]

Takken

[11] Patent Number: 4,754,719

[45] Date of Patent: Jul. 5, 1988

[54] MEANS OF ATTACHING APPLIQUES

[75] Inventor: Paul E. Takken, Hudsonville, Mich.

[73] Assignee: H. H. Cutler Company, Grand Rapids, Mich.

[21] Appl. No.: 897,304

[22] Filed: Aug. 18, 1986

[51] Int. Cl.[4] ..... D05C 7/08; D05B 21/00

[52] U.S. Cl. ..... 112/99; 112/121.15

[58] Field of Search ..... 112/99, 88, DIG. 1, 112/DIG. 2, DIG. 3, 121.15, 121.12, 121.11, 10

[56] References Cited

U.S. PATENT DOCUMENTS

| | | | |
|---|---|---|---|
| 2,879,825 | 3/1959 | Swackhamer | 112/121.15 X |
| 3,810,436 | 5/1974 | Marforio | 112/121.15 |
| 3,814,038 | 6/1974 | Dorosz et al. | 112/121.15 |
| 4,464,160 | 8/1984 | Joyce | 112/DIG. 3 |
| 4,498,404 | 2/1985 | Sadeh | 112/DIG. 2 |

FOREIGN PATENT DOCUMENTS

| | | | |
|---|---|---|---|
| 2009264 | 6/1979 | United Kingdom | 112/DIG. 2 |

*Primary Examiner*—H. Hampton Hunter

*Attorney, Agent, or Firm*—Price, Heneveld, Cooper, DeWitt & Litton

[57] ABSTRACT

For the purpose of sewing appliques to garments of an air porous fabric, the surface on which the garment is supported during the sewing process is provided with numerous small holes arranged in an area around the needle of the sewing machine. A source of vacuum is connected to these openings, the amount of vacuum being applied being adequate to hold the fabric of the garment firmly against the support surface and the applique firmly against the garment. The air pressure differential created by the vacuum is sufficient to positively hold the applique in place even though it and the garment are moved rapidly to align the target to be stitched with the needle.

5 Claims, 3 Drawing Sheets

MEANS OF ATTACHING APPLIQUES

FIELD OF THE INVENTION

The invention relates to the manufacture of clothing and more particularly to a method of attaching appliques to the garments.

BACKGROUND OF THE INVENTION

In the manufacture of many garments, particularly sportswear, infants' and children's wear, decorative appliques are applied to the garment. Basically, two methods of attachment are utilized. One method is to attach the applique solely by bonding with a suitable adhesive. A second method is to attach the applique by sewing. The use of adhesives is considered less desirable than sewing because adhesives, on occasion, lose their bonding ability as a result of dry cleaning or laundering and, thus, the applique becomes detached. Also, many adhesives, when applied in film thickness adequate for permanent attachment, tend to make the applique stiff and, thereby, produce an area of the garment which does not have the same flexibility as the rest of the garment. On the other hand, attaching the appliques by sewing is more expensive because it is time consuming and requires substantially more sophisticated equipment. There is also involved substantial hand labor. Each applique must be accurately placed on the garment and after placing, it must be held in position at least until it has been sufficiently attached that it will not become displaced during the sewing and, thereby, misaligned on the garment. Also, the sewing used to attach the appliques is a type of hemming which follows the perimeter of the applique and, thus, the sewing must accurately follow this perimeter in order to make a neatly finished product. The outline of many appliques is complex and must be carefully followed. Also, in many cases, besides border hemming, designs are applied to the surface of the applique by the sewing machine at the time the applique is attached to the garment. Once again, accuracy of location is very important to the production of a neat and acceptable finished product.

Current practice in attaching appliques to fabric garments is to apply a thin film of a heat sensitive adhesive to the back of the applique. The operator locates the applique on the garment and applies heat to the applique for a time sufficient to activate the adhesive and bond the applique to the fabric. This is a costly procedure for several reasons. First, the application of the adhesive to the applique increases the cost of the applique. The operator time required to heat the applique sufficiently to assure an adequate bond makes the operation labor intensive. Also, it requires the operator to be very careful in locating the applique and holding it in position during the application of the heat because once the adhesive has been activated, the applique's location is fixed. In addition, the use of the adhesive reduces the desirability of the end product because it adds a degree of stiffness to the applique. This is true even though only a thin layer of adhesive can be used since the adhesive's working life is short because, once the sewing has been done, the adhesive's function is complete and its presence becomes redundant. Despite these shortcomings the outlined procedure is standard practice for the attachment of appliques to fabric products such as garments.

BRIEF DESCRIPTION OF THE INVENTION

Applicant's invention makes it possible to apply a vacuum to the back of the fabric and by drawing air through the fabric, an applique placed on the fabric's surface will be pulled tightly against the fabric. In the case of most fabrics, the tight contact between the applique and the fabric resulting from the use of the vacuum holds the applique firmly in place where it will not become displaced unless it is positively and intentionally moved by the operator. The use of the vacuum makes it possible for the operator to very accurately and quickly locate the applique because the operator can adjust the applique's position while the applique is in contact with the fabric surface and once having positioned it, does not have to touch it again. This arrangement reduces labor costs and it permits quick and accurate positioning of the applique and also eliminates the cost of the adhesive and the time and labor required to set the adhesive by the application of heat. The invention makes it possible to use a vacuum to hold down, even relatively small appliques. Other advantages of this invention will be understood by those skilled in the art of clothing manufacture upon reading the following specification and the accompanying drawings.

IN THE DRAWINGS

DESCRIPTION OF THE PREFERRED EMBODIMENT

Figure 1:
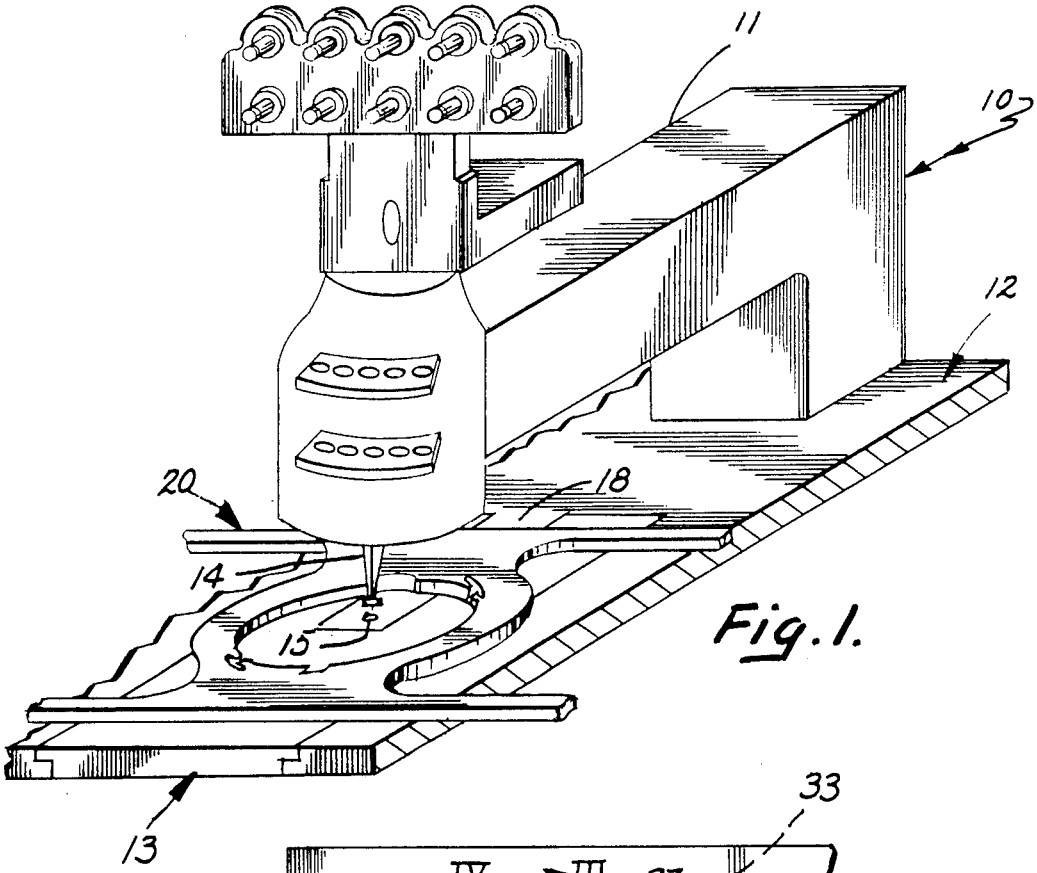
FIG. 1 is a fragmentary oblique view of a sewing machine with a typical fabric support.

The numeral 10 refers to a sewing machine illustrated in somewhat schematic form. The sewing machine has a main body including an arm 11 which is cantilevered out over a flat, stationary fabric or work support surface 12. Part of the surface is formed by a removable panel 13. At the outer end of the cantilevered arm 11 the sewing head mounts a needle 14 which, when operated, reciprocates through a hole 15 in the stationary part 18 of the support surface 12. Beneath the surface 12 the sewing machine has a second cantilevered arm 16 at the outer end of which is the bobbin mechanism 17 which cooperates with the needle 14 to complete the stitches as the needle reciprocates through the hole 15. The removable panel 13 is generally U-shaped having a pair of arms, one on each side of a slot 19 which receives the stationary portion 18 of the surface overlying the arm 16. The panel 13 is made removable to provide access for servicing the bobbin mechanism. For this purpose the panel is made to be slidably removable away from the sewing machine. Slidably mounted on the surface 12 is a frame 20. The sewing machine, support surface and frame are conventional in structure and form no part of this invention. They are available from various sources which manufacture this type of equipment. In fact, in this type of commercial equipment, a single machine includes a number of sewing machine units ganged together for common operation. Examples of sewing machine equipment to which this invention can be applied include a machine offered for sale as the BEJRC-UF 12 by Macpherson, Inc., P.O. Box 1889, Greenboro, N.C. 27402. Another machine to which the vacuum applique hold down of this invention can be applied is the Eltac High-Speed Automatic Embroidering Machine, Models 1600 and 1800, offered for sale by Texknit Machinery Limited, Pleasant Drive, Lochmere, N.H. 03252.

The invention is illustrated in FIGS. 2–5. To provide means for holding down an applique, once it has been placed on the fabric, the lower face of the panel 13 is recessed to form a U-shaped chamber 33 which extends forwardly from the end of the slot 19 and rearwardly a portion of the distance back along each side of the slot. The recess is sealed from the slot 19 by a wall 34 and is closed on the remainder of its perimeter so that when the cover plate 35 is secured to the bottom face of the panel, a closed chamber 33 is formed by the recess. It will be recognized that if the panel 13 is too thin to form the recess, dependent walls can be secured to the lower face of the panel 13 and the plate 35 attached to them to form a closed chamber. In the area of the chamber 33, a number of small air holes 37 extend through the panel to permit air to flow from above the panel through the air holes into the chamber 33. The holes are arranged in a closely spaced pattern of a size and shape designed to accommodate both the smallest and the largest of the appliques it is expected will be used with the invention. The quantity and capacity of the holes is such as to permit a substantial quantity of air to be withdrawn through the panel into the chamber. The chamber is connected to a vacuum source 40 by means of a conduit 41 which communicates with the chamber at any suitable location. Thus, when the vacuum source 40 is activated, air is withdrawn from the chamber at a sufficient rate that a significant air pressure differential is created between the top and bottom surfaces of the applique to assure positive anchoring of the applique to the fabric. It will be noted in this description that the hole 15 for the needle and the area immediately adjacent the bobbin assembly are completely isolated from the vacuum in the chamber 33.

Figure 3:
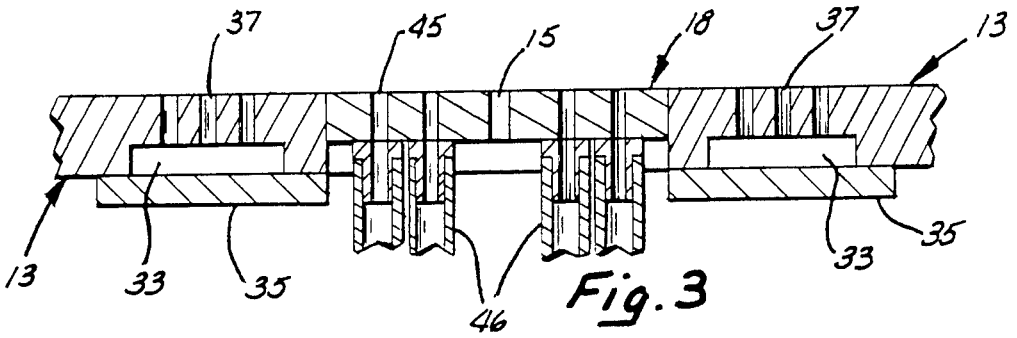
FIG. 3 is an enlarged, sectional view partially fragmentary taken along the plane III—III of FIG. 2.

A number of holes 45 are provided in the tongue-like stationary portion 18 of the surface 12 in the vicinity of the needle hole 15. Each of these holes is individually connected to the vacuum source by a conduit 46. The conduits 46 can be connected directly to the vacuum source 40 or they can be connected to a manifold 47 (FIG. 3). Preferably, the conduit 41 and the conduits 46 are all flexible tubes of substantial length. Particularly in the case of the conduit 41, this is desirable because it would permit the removable plate 13 to be pulled forwardly out of the platform when it is necessary to service the bobbin mechanism without disconnecting the conduit 41.

Figure 3A:
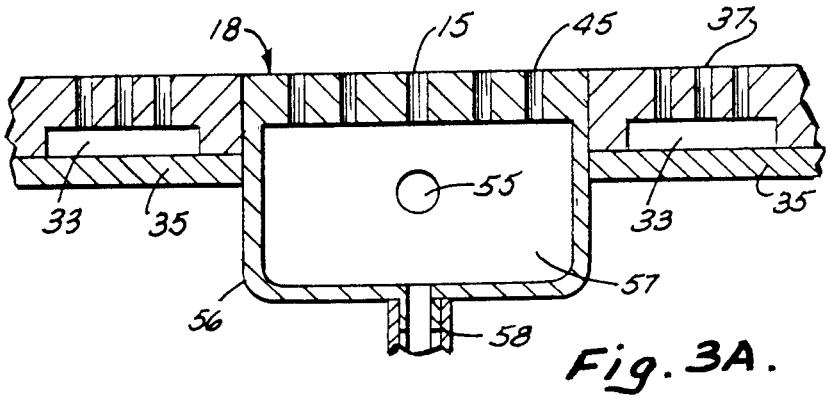
FIG. 3A is an enlarged sectional view similar to FIG. 3 illustrating a modified construction for the invention.
Figure 4:
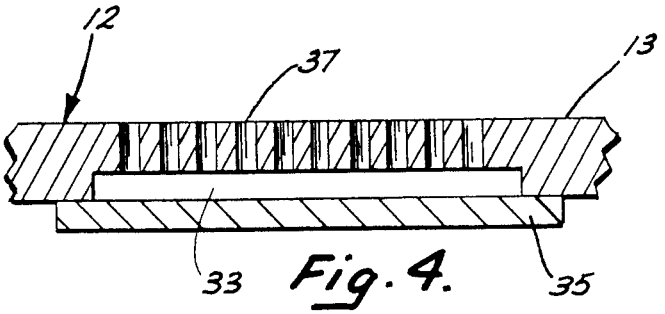
FIG. 4 is an enlarged fragmentary view taken along the plane IV—IV of FIG. 2.
Figure 5:
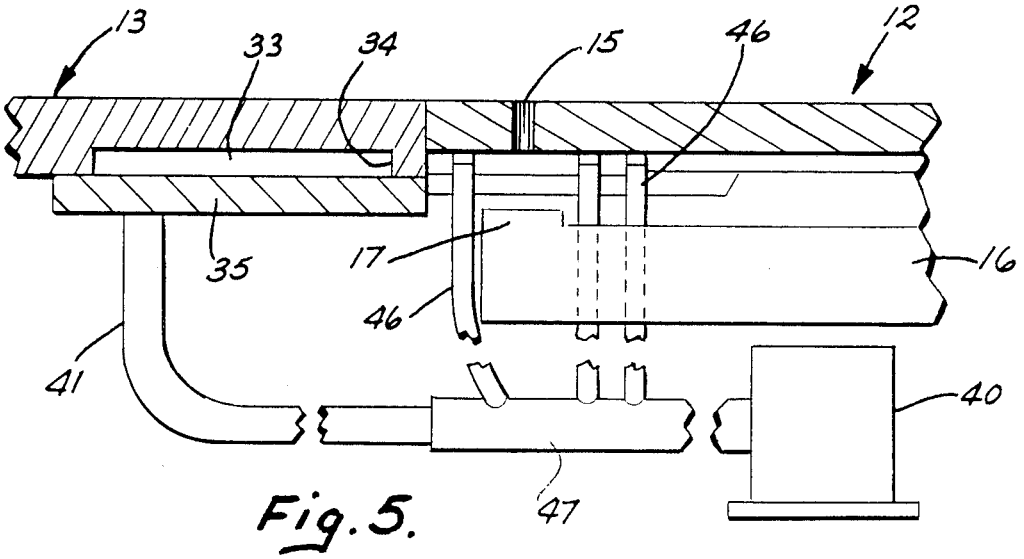
FIG. 5 is an enlarged fragmentary sectional view taken along the plane V—V of FIG. 2.
Figure 6:
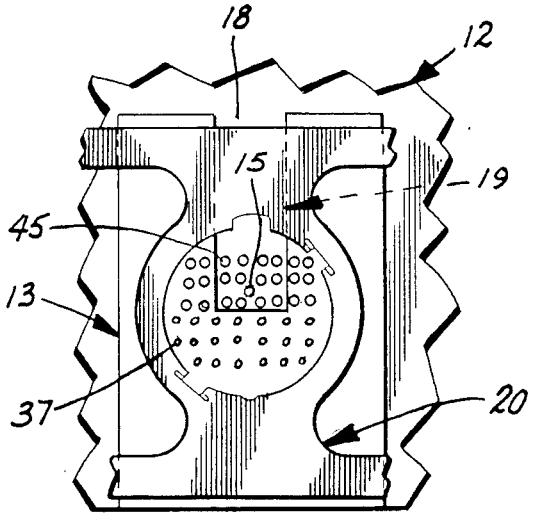
FIG. 6 is a fragmentary plan view of the support surface and the fabric holding frame.

It has been discovered that it is unnecessary to isolate the needle and hook chamber from the vacuum. FIG. 3A illustrates this. In this arrangement, the hook and its drive shaft 55 are surrounded by a housing 56 forming a chamber 57 which is connected to the vacuum source by a flexible conduit 58. This arrangement eliminates the necessity for the individual conduits 46 illustrated in FIG. 3.

Figure 2:
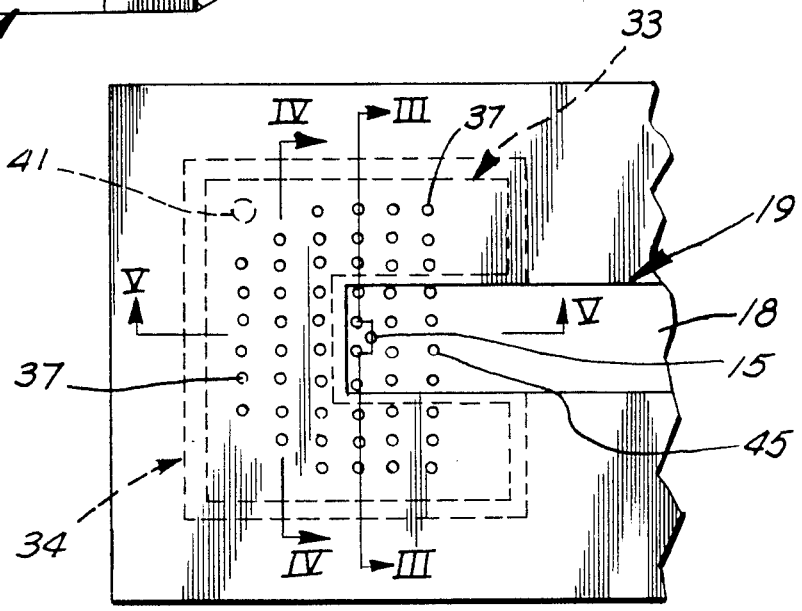
FIG. 2 is a plan view of the panel on which the fabric holding frame rests.

The vacuum source 40 can be any suitable commercially available, conventional equipment such as an air pump of the piston or fan type, so long as it has adequate air moving capacity to create an adequate vacuum. A hole pattern, which has proven to be successful for many appliques, is illustrated in FIG. 2. In this pattern, the holes are each $\frac{1}{8}$ inch in diameter and spaced apart $\frac{1}{2}$ inch laterally and $\frac{5}{8}$ inch in the forward and backward direction providing a total of 54 holes. This provides a vacuum effective surface area in excess of 48 square inches. This is exemplary only since the size of the hole pattern and the spacing of the holes can be increased or reduced depending upon the requirements of the particular appliques to be attached.

Figure 7:
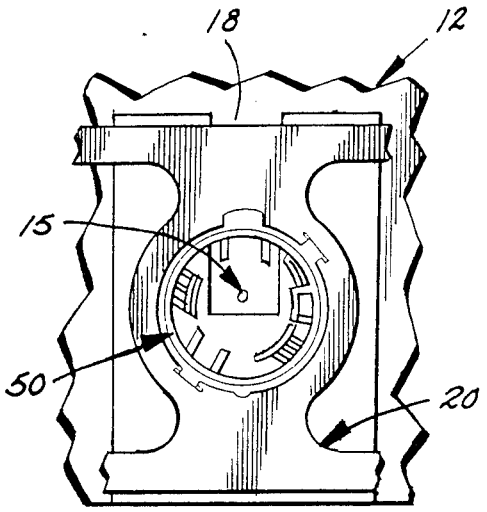
FIG. 7 is a plan view similar to FIG. 6 showing the fabric locking frame seated in the frame with the vacuum holes omitted for clarity.
Figure 8:
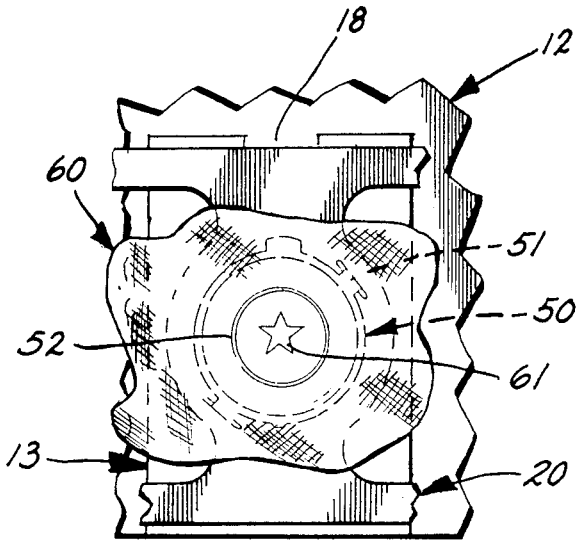
FIG. 8 is a view similar to FIG. 6 showing the fabric locked in place with the applique ready for sewing.

In utilizing the invention, a clamping frame 50 is mounted within the generally circular opening in the frame 20 and is locked in position by means of the key slots 51 (FIG. 7). The fabric 60 is then placed over the clamping frame and a locking hoop 52 is inserted into the central portion of the locking frame to clamp the fabric tightly between the locking frame and the hoop (FIG. 8). The insertion of the hoop also stretches the fabric to make it taut. In doing this, the operator is careful to locate the applique target area in the proper position to register with the needle 14. This again is conventional practice and is not part of this invention because this step has to be performed whether this invention and its methodology are used or the more conventional practices previously practiced are utilized. Once the fabric is clamped within the clamping frame, the vacuum is turned on and the applique is placed within the frame and is located in accordance with appropriate markings which have normally been applied to the fabric to provide reference points for its location (FIG. 8). In doing this, the operator can move the applique around on the surface of the fabric until it is properly located. However, in the absence of the operator's positive action to move the applique, the vacuum holds the applique tightly against the surface of the fabric. Furthermore, since a vacuum is being used, the applique will be held in a wrinkle free condition against the surface which is important to proper mounting of the applique. The properly positioned applique is illustrated in FIG. 8 prior to the applique being permanently secured by sewing. In this condition, the fabric, upon which the applique has been placed is pulled by the vacuum firmly against the surface of the platform which, preferably, is made of a material having a low coefficient of friction, whereby, the fabric can slide across the surface with a minimum of resistance.

Figure 9:
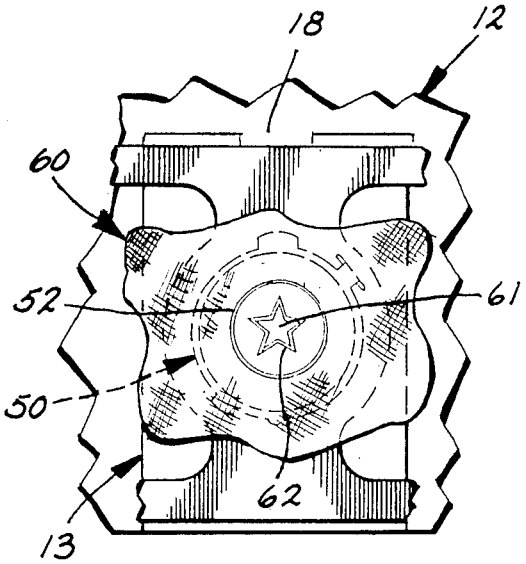
FIG. 9 is a view similar to FIG. 8 but showing the applique after it has been sewn in place.

Once the applique 61 has been properly positioned, the sewing machine is activated and through coordinated means, which are neither illustrated nor part of this invention and are here treated as conventional, since they are available from numerous sources, the frame 20 is moved to shift the fabric and the applique through a pattern such that the applique and the fabric are continuously positioned with reference to the needle to produce the desired pattern of sewing, as for example, in outlining or border stitching the star illustrated in FIG. 8 to produce the border 62 illustrated in FIG. 9. In this arrangement, the vacuum is particularly desirable because it permits the fabric to be moved in any direction with the same degree of force being applied by the vacuum to hold the applique tightly against the fabric and free of wrinkles. Thus, the ability of the fabric to slide across the smooth surface coupled with the firm clamping pressure resulting from the vacuum provide an effective means of positively holding the applique during the sewing operation. To provide the pattern stitched by the needle, the fabric and applique are moved relatively to the needle. This is done by moving the frame 20 over the support surface 12. These movements normally follow a complex pattern and are made at very high speeds. This requires fast, frequent, accurate and rapid movement of the frame. For this purpose, the vacuum is particularly effective in preventing any inadvertent displacement of the applique.

The means by which the frame 20 is moved and its movements controlled are conventional and are provided by a number of commercially available sewing systems to which the vacuum hold down concept can be applied. Normally the actuation of the needle and the pattern of movement of the frame are controlled by computers programmed for the particular applique. This arrangement is also part of the sewing systems presently commercially available.

It will also be recognized that the invention is not confined to application only to sewing equipment having a work support surface of the specific construction described above. In some sewing equipment, only that portion of the surface which is adjacent to and includes the needle hole is made removable. In such a case, the chamber arrangement can surround the removable portion of the surface and the openings connected to the vacuum source by individual tubes will service the vacuum openings in the removable portion.

It will be recognized that this invention cannot be applied to garment materials which are not air permeable or are only slightly air permeable. However, most garments to which appliques of this type are applied are fabrics which will pass a substantial quantity of air because of their texture. An advantage of this invention is the fact that it does not, in any way, mar the surface appearance of the fabric since there are no adhesives, or other fabric surface adversely affecting materials used during the process of properly locating and holding the applique. Furthermore, the invention will work with appliques of many sizes and shapes, just so long as the fabric of the garment is permeable to air. If the applique itself is of a material not permeable to air, it will be held even more tightly against the garment than would be an applique with some degree of air permeability.

Having described my invention and its application, it will be recognized that various modifications of the invention can be made without departing from the principles of the invention. Such modifications are to be considered as included in the hereinafter appended claims unless these claims by their language, expressly state otherwise.

I claim:

1. Means on a sewing machine for temporarily holding an applique against a web of air permeable material in preparation for permanently attaching the applique to the web, said sewing machine having a sewing element including a needle for stitching the applique to the web and a panel having first and second portions forming a web supporting surface, said second panel portion having a hole therein through which said needle reciprocates in forming stitches; said means comprising: a vacuum chamber beneath said first panel portion extending on both sides of said needle hole and in front of said needle hole; said vacuum chamber having walls extending entirely around its periphery; a plate secured to said walls and closing the lower face of said vacuum chamber; a plurality of openings extending from said vacuum chamber upwardly through said surface of said first panel portion arranged in a pattern on each side of and in front of said needle hole, said pattern of holes being co-extensive with said vacuum chamber; a source of vacuum and means connecting said source to said vacuum chamber; a second plurality of openings through said second panel portion adjacent to and arranged in a pattern closely adjacent to and around said needle opening and a plurality of second means each separately providing a source of vacuum to each of said holes whereby said needle is isolated from the vacuum.

2. Means for temporarily holding an applique as described in claim 1 wherein, said vacuum chamber is recessed into the lower face of said panel.

3. Means for temporarily holding an applique as described in claim 1 wherein a hook chamber is provided below the needle opening for a stitch forming member, a housing enclosing said hook chamber and second means connecting said hook chamber to said source of vacuum whereby said first panel portion and its vacuum chamber can be moved for service independently of said second panel portion and hook chamber.

4. Means on a sewing machine for temporarily holding an applique against a web of air permeable material in preparation for permanently attaching the applique to the web, said sewing machine having a sewing element including a needle for stitching the applique to the web and a panel having first and second portions forming a web supporting surface, said second panel portion having a hole therein through which said needle reciprocates in forming stitches; said means comprising: a vacuum chamber beneath said first panel portion extending on both sides of said needle hole and in front of said needle hole; said vacuum chamber having walls extending entirely around its periphery; a plate secured to said walls and closing the lower face of said vacuum chamber; a plurality of openings extending from said vacuum chamber upwardly through said surface of said first panel portion arranged in a pattern on each side of and in front of said needle hole, said pattern of holes being co-extensive with said vacuum chamber; a source of vacuum and means connecting said source to said vacuum chamber; said panel having first and second portions, said vacuum chamber being beneath said first portion of said panel and a hook chamber being beneath said second portion; said first portion being removable; said connecting means for said vacuum chamber being a flexible conduit of a length such that said first panel can be removed from its normal operating position without disconnecting said conduit.

5. Means for temporarily holding an applique as described in claim 8 wherein vacuum holes are provided in said second panel portion adjacent said needle and individual conduits separately connecting each of said vacuum holes to said vacuum source.

* * * * *

UNITED STATES PATENT AND TRADEMARK OFFICE

CERTIFICATE OF CORRECTION

PATENT NO. : 4,754,719

DATED : July 5, 1988

INVENTOR(S) : Paul E. Takken

It is certified that error appears in the above-identified patent and that said Letters Patent is hereby corrected as shown below:

Column 6, line 61:
"8" should be --4--

Signed and Sealed this

Seventh Day of March, 1989

*Attest:*

DONALD J. QUIGG

*Attesting Officer*

*Commissioner of Patents and Trademarks*